United States Patent [19]

Witt et al.

[11] Patent Number: 4,538,519

[45] Date of Patent: Sep. 3, 1985

[54] WARHEAD UNIT

[75] Inventors: Wolfram Witt; Manfred Moll, both of Duesseldorf, Fed. Rep. of Germany

[73] Assignee: Rheinmetall GmbH, Duesseldorf, Fed. Rep. of Germany

[21] Appl. No.: 578,056

[22] Filed: Feb. 8, 1984

[30] Foreign Application Priority Data

Feb. 25, 1983 [DE] Fed. Rep. of Germany ..... 3306659

[51] Int. Cl.[3] ..... F42B 25/02; F42B 11/28

[52] U.S. Cl. ..... 102/387; 102/306; 102/475

[58] Field of Search ..... 102/386, 387, 384, 388, 102/306, 475, 476

[56] References Cited

U.S. PATENT DOCUMENTS 3,875,862 4/1975 Fischer et al. ..... 102/476 X 4,050,381 9/1977 Heinemann ..... 102/387

4,296,685 10/1981 Romer et al. ..... 102/387

FOREIGN PATENT DOCUMENTS 2478297 9/1981 France ..... 102/387

1444029 7/1976 United Kingdom ..... 102/387

*Primary Examiner*—David H. Brown

[57] ABSTRACT

A warhead unit carrying a pay load and being suspended from a parachute which brakes the descent of the warhead unit. The pay load includes a sensor for detecting a target and a projectile-forming charge which is fired from the pay load when activated by the sensor. The pay load is rotated by jet nozzles first about a longitudinal axis and then about a diagonal axis after the point of suspension has been shifted from the center of the top surface of the pay load to a corner of the top surface of the pay load.

6 Claims, 5 Drawing Figures

WARHEAD UNIT

BACKGROUND OF THE INvENTION

Warhead units which are transported over a target region via a carrier missile and are then expelled and descend onto the target region while being suspended from parachutes are wellknown and described in the coassigned U.S. Pat. No. 4,289,073. Such warhead units are preponderantly used for combatting armored vehicles. Such combat units generally include a sensor for detecting the target region and scanning the same and a charge in the form of a projectile (P-charge, S-charge), which after the target region has been detected and scanned, releases such charge from the warhead unit.

It is also known, in order to enlarge the detection probability, to scan the target region spirally by means of the sensor. It is furthermore known to construct the projectile-forming charge in such a way that a longitudinally extending projectile having a large length to the diameter ratio is formed, which so-formed projectile, in comparison to the spherical-symmetrical-projectiles, can achieve an increased penetration capability. The projectile-forming charges produce, however, such projectiles having a large ratio of length to diameter, which in particular when large combat distances have to be traversed, do not fulfill the present expectations, because they are comparatively unstable in flight and in certain unfavorable cases also rotate about their transverse axis. Therefore, despite their high penetration potential, such projectiles in many cases are inferior to the stably flying, essentially spherical-symmetrical shaped projectiles.

SUMMARY OF THE INVENTION

It is therefore a general object of this invention to provide a warhead unit whose combat capability is increased by virtue of the fact that it ejects charges in the form of spin-stabilized projectiles.

BRIEF DESCRIPTION OF THE DRAWING

With these and other objects in view, which will become apparent in the following detailed description, the present invention, which is shown by example only, will be clearly understood in connection with the accompanying drawing, in which.

DETAILED DESCRIPTION

Figure 1:
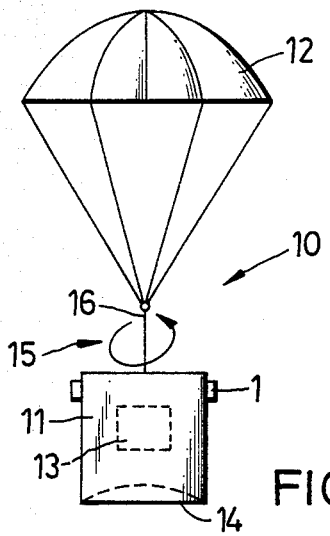
FIG. 1 is a schematic representation of a warhead unit having been expelled from a carrier projectile which warhead unit includes a pay load component and a parachute during a first flight phase.

FIG. 1 illustrates a schematic representation of a warhead unit 10 which has been expelled from a carrier projectile and is in the process of descending over a target region. The warhead unit 10 includes a pay load portion 11 which is suspended from a parachute 12 and thereby its descent is braked. The pay load portion 11 carries a sensor 13 and a projectile-forming charge 14, which is also only illustrated schematically in FIG. 1. This projectile-forming charge 14 produces, upon the emission of a release signal by the sensor 13, a projectile having a large length to diameter ratio. Such a projectile, in a manner similar to those projectiles which are fired from tank cannons, has, as a result of its inherent kinetic energy, a large penetration capability. Practical tests have demonstrated that the theoretically attainable penetration capability can, however, be attained only over a comparatively short distance. This is due to the fact that such a projectile lacks stability during flight and tends over large flight distances to oscillate or even rotate about its transverse axis. Such projectiles impact therefore frequently only with a very flat impact angle onto the to be combatted target and therefore do not reach the desired effect, because they either are deflected or only slightly damage the armor plating. A spin-stabilization of such a projectile can advantageously achieve a significant capability with the result of an armor-plate penetration even over large distances.

This spin-stabilization is achieved by imparting at least to the pay load portion 11 of the descending warhead unit 10 a spin in the direction of the arrow 15 in FIG. 1 about a vertical axis 16. This rotational motion is achieved advantageously by means of drive nozzles 1 disposed on the outer periphery of the pay load portion 11, which are armed with non-illustrated pyrotechnical charges. The pay load portion 11 which is so-placed in rotation is at least capable to combat a target region which is immediately disposed below it.

Figure 2:
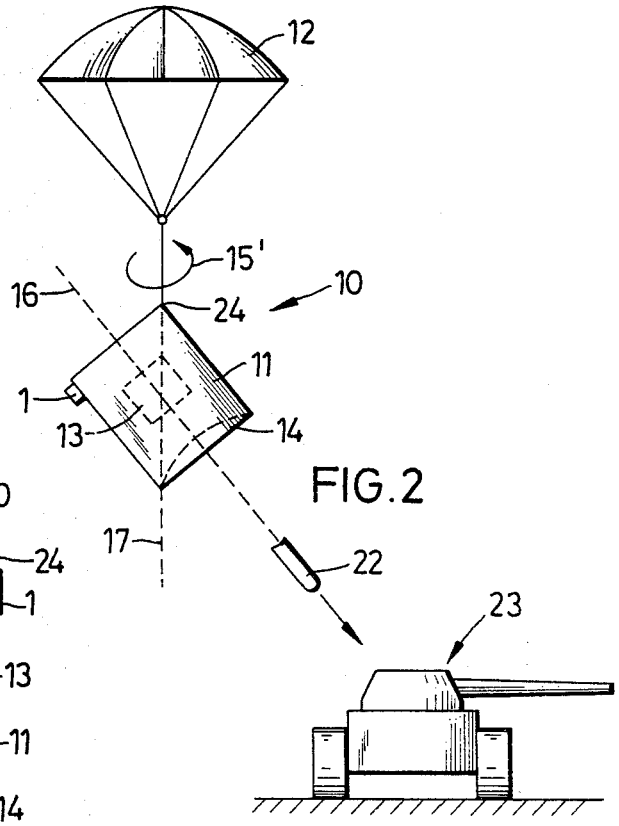
FIG. 2 is a schematic illustration of the warhead unit in a second flight phase after termination of the search process and at the moment of the firing of a projectile onto a detected target.
Figure 3:
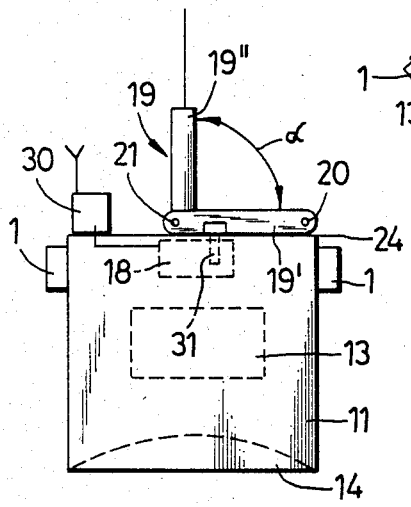
FIG.3 is an enlarged schematic representation of the warhead unit in accordance with FIG. 1.

In order to increase the sensing and scanning capability of the sensor 13 and thereby in the final analysis to expand the combat effectiveness of the warhead unit, the pay load portion of the warhead unit must, in its further descent, with the therein arranged sensor 13, assume a favorable scanning position, in which the potential target region can by systematically scanned. This scanning is particularly successful when the sensor 13 scans the target region in a gapless manner, which means in the form of a helical motion. Such motion can advantageously be attained in a simple manner, which is as follows: At the beginning of the scanning process the connecting point between the pay load portion 11 and the parachute 12, coincides with the rotational axis 16. This point is transferred, as is indicated in FIG. 2, to a corner point of the pay load portion 11. As a result of this displacement the pay load portion 11 is now suspended from the parachute 12 along a diagonal line 17. As a result of physical laws covering gyroscopic motions the pay load portion 11 rotates as indicated by the arrow 15' about an axis which coincides with the diagonal line 17 of the pay load portion 11. The sensor arranged in the pay load portion 11 scans thereby during the further descent of the warhead unit 10 the target disposed below it by means of a spiral-shaped search path. Once a target has been detected, for example, a tank 23, the sensor 13 emits a release signal for the projectile-forming charge 14, which then fires a spin-stabilized projectile 22 towards the recognized target. FIG. 3 illustrates a means for displacing the suspension point of the pay load portion 11 from the parachute 12. These means include a hinge-like connecting member 19, the first shank 19' of which is disposed during the first flight-phase of the warhead unit 10 (FIG. 1) flatly along the upper side of the pay load portion 11 and is hingedly connected about the rotational axis 20 to the pay load portion 11 in the region of its corner point. The second shank 19'' of the connecting member 19 is disposed during a first flight phase along the rotational axis 16, along which the connection between the pay load portion 11 and the parachute 12 also lies. When a shift into the second search phase occurs the displacement of the parachute connection point from a position along the rotational axis 16 to a position along the diagonal 17 of the pay load portion 11 is introduced. Such shifting in position occurs when first the shank 19' of the connecting member 19, which is disposed flatly on the upper side of the pay load portion 11, is first lifted off from this upper surface in such a way that it only remains connected to the pay load portion by means of the pivot hinge point 20. This separation of the shank 19' from the upper surface of the pay load portion 11 can be effected by means of a pyrotechnical charge 18 which has only been illustrated schematically in FIG. 3. The release of this pyrotechnical charge 18 can be effected by means of a timer-igniter which is ignited by means of a signal which could be released by an altimeter 30 (also illustrated only schematically in FIGS. 3 and 4) disposed in the pay load portion 11 or by means of a radio signal (element 30 can also be a radio signal receiver). After the shank 19' has been so-released by the pyrotechnical charge 18 the shanks 19', 19'' extend linearly by pivoting about the pivot point connection 21 which connects both shanks 19' and 19''. The connecting or suspension member 19 therefore assume a position which coincides with the diagonal axis 17 of the pay load portion 11.

Figure 4:
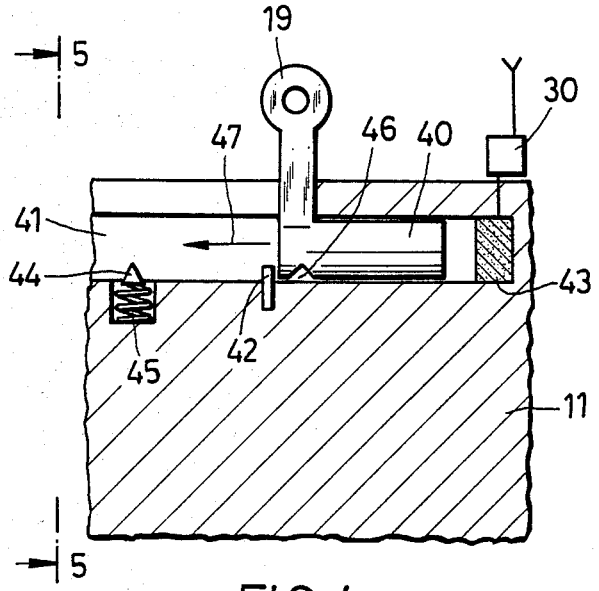
FIG. 4 is a partial cross-sectional schematic representation of an alternate embodiment for suspending the warhead unit from a parachute.
Figure 5:
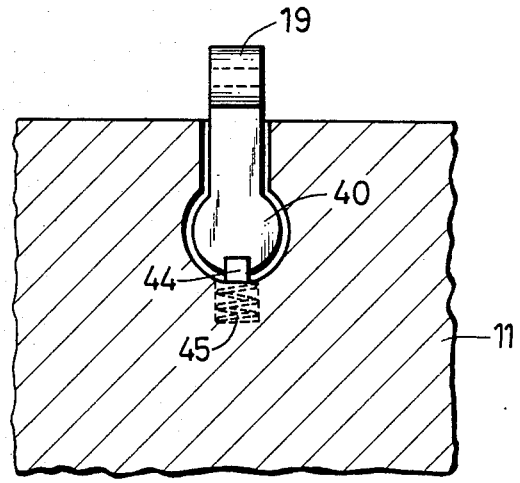
FIG. 5 is a cross-sectional view along line 5—5 of FIG. 4.

In a further embodiment of the invention (FIGS. 4 and 5), a rigid, which means a non-hinge-like connecting member 40 is used between the pay load portion 11 and the parachute 12. In this embodiment the pay load portion 11 is, during its descent, first arranged at the axis 16, where it is suspended via an L-shaped member having a radially, outwardly extending leg fixed adjacent to the top surface of the pay load 11. The L-shaped connecting member can advantageously be displaced outwardly into an outer position in which it is fixedly held. As soon as the spirally-shaped scanning movement is to be introduced, by means of additional rotation of the pay load 11 about the axis 17, the connecting member is preferably shifted radially outwardly by means of a pyrotechnical charge 43, so that as a result of its release the connecting member is guided by means of one leg in a radial outward direction, whereby the connecting point between the parachute 12 and the pay load 11 is now disposed along the diagonal of the pay load portion 11. in FIGS. 4 and 5 there is illustrated the aforedescribed additional embodiment of the suspension mode in detail. FIG. 4 illustrates the longitudinal sectional partial view through the pay load 11, whereas FIG. 5 illustrates a view turned 90° from that of FIG. 4 along line 5—5 of FIG. 4. The parachute 12 has not been illustrated in FIGS. 4 and 5 and this parachute 12 is connected through the bore of the connecting member 19, which member 19 has a leg portion 40 in the form of a piston rod which is slidably movably disposed in the bore 41 of the pay load 11 so as to be movable in a radial direction. The connecting member 19 is held in a first operative position by means of a shear pin 42, in which first position the parachute 12 suspends the pay load 11 along the axis 16 (see FIG. 1). In a similar manner a shear pin 31 can be mounted in the embodiment of FIG. 3 which shear pin is severed by the charge 18. Prior to expulsion of the pay load 11 there is provided a high gas pressure in the bore 41 by means of the ignition of a pyrotechnical charge 43, which causes the connecting member 19 together with its piston rod-shaped portion 40 to move along the arrow 47 in a radially outward direction until a safety pin 44 biased by means of a coil spring 45 matingly meshes with a recess 46 in the piston rod-like member 40. Thereby the connecting member 19 is moved into a second fixed position. In this second fixed position the point of suspension of the parachute is disposed eccentrically with respect to the pay load 11, which means that the parachute 12 now is suspended along the axis 17 (see FIG. 2).

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. An improved warhead carrying a pay load and having a parachute which brakes the descent of the warhead onto a target region, including a sensor for detecting a target and a projectile forming explosive charge, the improvement comprising, that during the descent the pay load of the warhead is suspended from a parachute via a connecting member;

means for rotating the pay load about a first longitudinal axis; and means for transferring the point at which said pay load is suspended via said connecting member from said parachute from a central region of said pay load to a corner region thereof.

2. The improvement in a warhead as set forth in claim 1, wherein said connecting member is L-shaped and the parachute is connected to the free end of one of the legs of the L-shaped member, said pay load has a blind bore and the other leg of said L-shaped member is slidably movably mounted in said blind bore, a pyrotechnical explosive charge is operatively mounted in said pay load adjacent to said blind bore, a shear pin projects into said blind bore and blocks the movement of said L-shaped member in said blind bore so as to maintain said L-shaped member in a first position in which said pay load is suspended from a central region, and biasing means operatively mounted in said blind bore for maintaining said L-shaped member in a second position in which said pay load is suspended from a radially outer region.

3. The improvement in a warhead as set forth in claim 1, wherein said connecting member has two legs which are pivotally connected to each other, a first leg is hinge-connected to said corner region of said pay load at one of its ends and is hingedly connected to a second leg at the other of its ends, the second leg is connected to said parachute, and the first leg is detachably secured on the top surface of said pay load, except for the hinge-connection which is not detachable.

4. The improvement in a warhead as set forth in claim 3, including means for maintaining said first leg in abutting contact with substantially its entire longitudinal extent with the top surface of said pay load so that the first leg forms an angle of 90° between each other, during a first flight phase of said pay load, and means for detaching said first leg from said top surface of said pay load over its entire longitudinal extent but not including detachment of said hinge connection at said corner region during a second flight phase.

5. The improvement in a warhead as set forth in claim 4, wherein said means for detaching said first leg from the top surface of said pay load includes a pyrotechnical charge mounted in the upper region of said pay load which is ignitable by means of a delayed time fuse which is operatively connected to an altimeter mounted in said pay load.

6. The improvement in a warhead as set forth in claim 4, wherein said means for detaching said first leg from the top surface of said pay load includes a pyrotechnical charge mounted in the upper region of said pay load which is ignitable by means of a radio signal.

* * * * *